US005975474A

United States Patent [19]

Kaplan et al.

[11] Patent Number: 5,975,474

[45] **Date of Patent: *Nov. 2, 1999**

[54] ARTICULATED KEYBOARD SHELF

[75] Inventors: Jonathan Ira Kaplan, Palo Alto; David John Law, Burlingame; Kevin Scott Nason, Mountain View, all of Calif.; David K. Jones, Grand Rapids, Mich.

[73] Assignee: Steelcase Inc., Grand Rapids, Mich.

[ * ] Notice: This patent is subject to a terminal disclaimer.

[21] Appl. No.: 09/087,551

[22] Filed: May 29, 1998

Related U.S. Application Data

[62] Division of application No. 08/561,667, Nov. 22, 1995, Pat. No. 5,836,560.

[51] Int. Cl.[6] ..... A47F 5/00

[52] U.S. Cl. ..... 248/289.11; 248/286.1; 248/284.1; 248/918

[58] Field of Search ..... 248/242, 276.1, 248/278.1, 284.1, 281.1, 286.1, 280.11, 289.11, 292.14, 648, 662, 918, 919, 118, 118.1, 118.3; 108/5, 6, 50, 93, 94, 138, 139, 145, 147, 27–29

[56] References Cited

U.S. PATENT DOCUMENTS

| | | | |
|---|---|---|---|
| D. 288,097 | 2/1987 | Harter et al. | D14/114 |
| 651,539 | 6/1900 | Warren . | |
| 719,625 | 2/1903 | Throm . | |
| 1,982,954 | 12/1934 | Grobe | 250/34 |
| 3,820,752 | 6/1974 | Oram | 248/278 |
| 4,545,555 | 10/1985 | Koch | 248/280.1 |
| 4,564,179 | 1/1986 | Hollingsworth | 269/71 |
| 4,616,798 | 10/1986 | Smeenge et al. | 248/281.1 |
| 4,706,919 | 11/1987 | Soberaiski et al. | 248/281.1 |
| 4,744,019 | 5/1988 | Krogsrud | 362/402 |
| 4,826,123 | 5/1989 | Hannah et al. | 248/248 |
| 4,834,329 | 5/1989 | Delapp | 248/183 |
| 4,863,133 | 9/1989 | Bonnell | 248/278 |
| 4,883,316 | 11/1989 | Austin, Jr. et al. | 297/191 |
| 4,976,407 | 12/1990 | Schwartz et al. | 248/118.3 |
| 5,048,784 | 9/1991 | Schwartz et al. | 248/118.3 |
| 5,564,667 | 10/1996 | Copeland et al. | 248/278.1 |
| 5,775,657 | 7/1998 | Hung | 248/279.1 |
| 5,836,560 | 11/1998 | Kaplan et al. | 248/286.1 |

FOREIGN PATENT DOCUMENTS

| | | |
|---|---|---|
| 2847135 | 5/1980 | Germany . |
| 60-163040 | 5/1984 | Japan . |
| 60-76428 | 5/1985 | Japan . |
| 60-77426 | 5/1985 | Japan . |
| 60-95036 | 6/1985 | Japan . |
| 60-180029 | 11/1985 | Japan . |
| 2176996 | 5/1985 | United Kingdom . |

OTHER PUBLICATIONS

Exhibit A (4 pgs.) is a disclosure prior art Häfele "K–Board Computer Keyboard" support mechanism, Cat No. 639.97.302, offered for sale at least as early as Nov. 21, 1994.

*Primary Examiner*—Ramon O. Ramirez
*Assistant Examiner*—Gwendolyn Baxter
*Attorney, Agent, or Firm*—Price, Heneveld, Cooper, DeWitt & Litton

[57] ABSTRACT

An adjustable support for data input devices and the like includes a base attached to an associated worksurface, a platform shaped to support the data input device thereon and having a front portion and a rearward portion. A support arm has one end pivotally joined with the base, and an opposite end pivotally joined to the platform. A brake element selectively engages a locking member, such that rotation of the tray about the second end of the support arm releases the brake element and permits changes in the elevation of the support with respect to the base, and the moment of the platform and any associated input device frictionally engages the braking element with the locking member and locks the platform in a selected position.

23 Claims, 14 Drawing Sheets

ARTICULATED KEYBOARD SHELF

CROSS-REFERENCE TO RELATED APPLICATION

This is a division of U.S. patent application Ser. No. 08/561,667 now U.S. Pat. No. 5,836,560 filed on Nov. 22, 1995, entitled ARTICULATED KEYBOARD SHELF, the contents of which is hereby incorporated by reference.

BACKGROUND OF THE INVENTION

This invention relates generally to adjustable supports, and in particular to an articulated tray or support for a data input device, such as a computer keyboard, mouse, or the like.

Personal computers are becoming more and more common in many industries and office environments, and such systems typically employ a keypad, mouse, and/or other data input device, such as a digitizing pad. Often, the personal computer occupies much of the desk or worksurface, making it difficult to locate the keyboard thereon. Furthermore, many users do not prefer to locate the keyboard on the desk top because it is uncomfortable to address the keyboard over the course of the workday.

A number of devices have been developed to offer greater flexibility in supporting the keyboard, mouse, or other device at a comfortable position relative to the user. Many of these systems are structurally complex and typically require rather awkward adjustments through manipulations of a number of knobs and levers or handles. Moreover, many of the adjustable keyboard supports available today utilize an adjustment system which is counter-intuitive, insofar as the end user must learn a detailed sequence of steps, knobs, locks, etc. before the device can be used effectively instead of simply moving the keyboard directly to the desired position.

To date, no one has provided an intuitive, stable, affordable, and mechanically simple keyboard support which retracts beneath the worksurface and provides keyboard height and tilt adjustment in a device which has few moving parts.

SUMMARY OF THE INVENTION

One aspect of the invention is to provide an adjustable support for data input devices and the like. In particular, an adjustable palm rest is provided for use with a keyboard support or tray, including a support that is shaped to be disposed adjacent a forward portion of the keyboard support. A slide is mounted adjacent the support, and configured to slide laterally back and forth in a plane generally parallel to the support. The slide includes at least one camming surface. A palm rest engages the camming surface, and is interconnected through the slide to the support whereby back and forth movement of the slide translates the palm rest vertically.

Another aspect of the invention is an auxiliary support assembly for attachment to the end of the keyboard platform, including a housing, an anchor member, a hinge assembly interconnecting the housing to the anchor member, and a latching mechanism biased within the housing and configured to engage the hinge assembly for fixing the housing in a selected orientation relative to the anchor.

Yet another aspect of the present invention is an articulated keyboard support assembly including a base member adapted for attachment to a support surface and an arm having a first end pivotally connected to the base member.

A keyboard support platform that is pivotally connected to a second end of the arm. A lock interconnects the keyboard support platform and the base member such that a moment of the keyboard support platform engages the lock and maintains a desired angular orientation of the arm with respect to the base member. The keyboard support assembly also includes a tilt adjustment mechanism that is configured to selectively support the keyboard support platform at a user-selected angle with respect to the base member.

Yet another aspect of the present invention is an articulated keyboard support assembly including a base member that is shaped for connection to a worksurface. A keyboard support platform is movably connected to the base for vertical movement relative to the base member. The keyboard support platform is movable to a position below the worksurface. A lock interconnects the platform and the base member. The platform is movable to a released position wherein the lock is released to permit height adjustment of the platform. The platform is also movable to a locked position wherein the lock retains the platform at a user-selected height at a selected one of a plurality of infinitesimally small increments.

Yet another aspect of the present invention is an articulated keyboard support assembly including a base member shaped for connection to a worksurface and a keyboard support platform that is movably connected to the base for vertical movement relative to the base. The platform includes a clamp for securely retaining a keyboard in position on the platform. The keyboard support assembly further includes a lock interconnecting the platform and the base member. The platform is movable to a released position wherein the lock is released to permit height adjustment of the platform. The platform is also movable to a locked position wherein the lock retains the platform at a user-selected height at a selected one of a plurality of infinitesimally small increments.

The principal objects of the present invention are to provide an adjustable support which requires few moving elements, provides a stable platform which is retractable for storage beneath the worksurface, and the operation of which is simple and intuitive, without the need to learn a sequence or series of operations involving knobs and levers.

The various embodiments of the invention described below all offer advantages not offered by the prior devices, including that the angle of the platform with respect to the base remains substantially constant as the height is adjusted, the structure has very few parts, and the entire assembly impacts little on storage space due to its essentially planar profile. Furthermore, the adjustable support operates in an intuitive manner, allowing the user to quickly and easily position the platform at the appropriate height and angle without the adjustment of a plurality of knobs. Other advantages will become apparent based on the description of the invention provided below with reference to the drawing figures.

DESCRIPTION OF THE DRAWING FIGURES

DETAILED DESCRIPTION OF THE PREFERRED EMBODIMENTS

Figure 1:
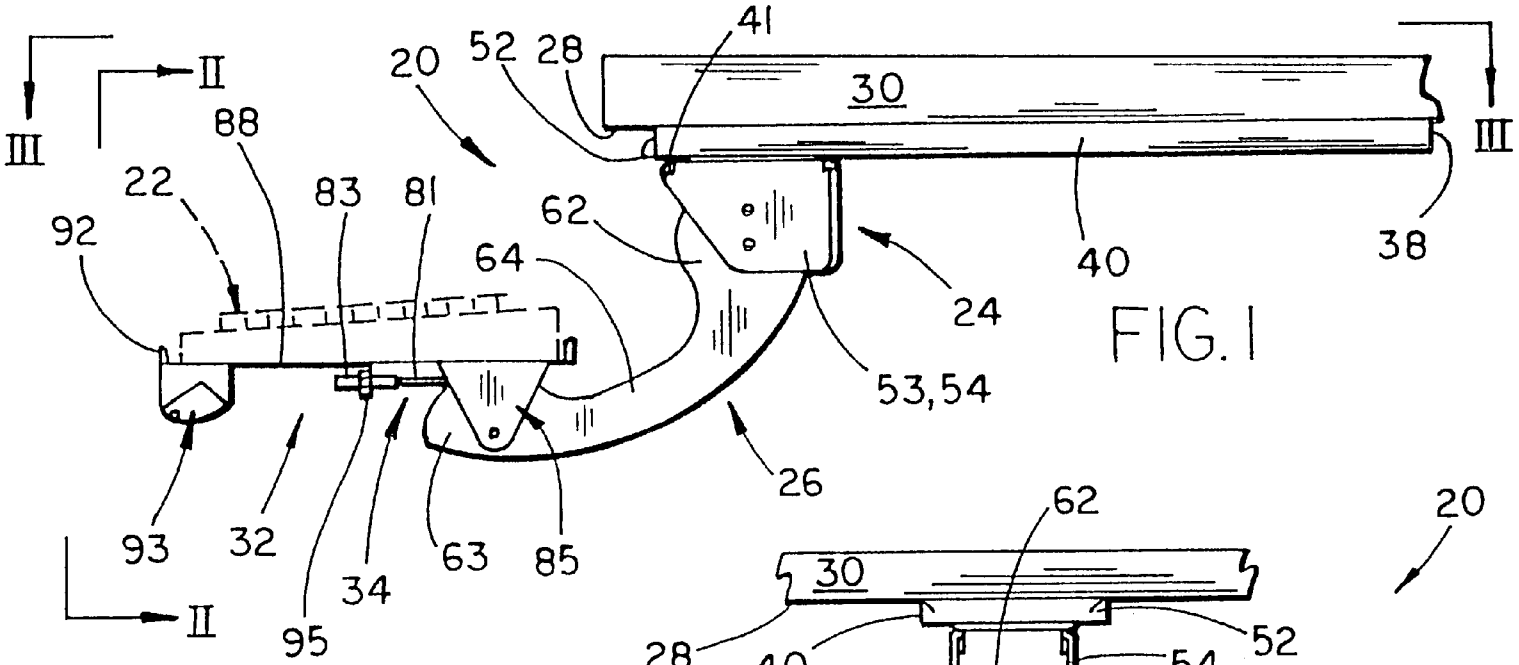
FIG. 1 is a side elevation view of one embodiment of an adjustable support embodying the invention.
Figure 2:
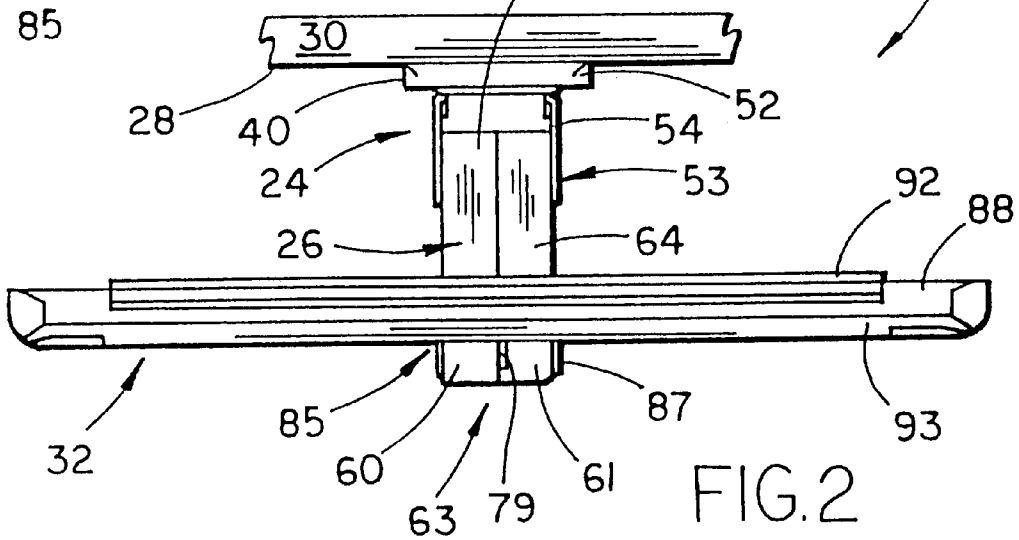
FIG. 2 is a front elevation view of the invention shown in FIG. 1.
Figure 3:
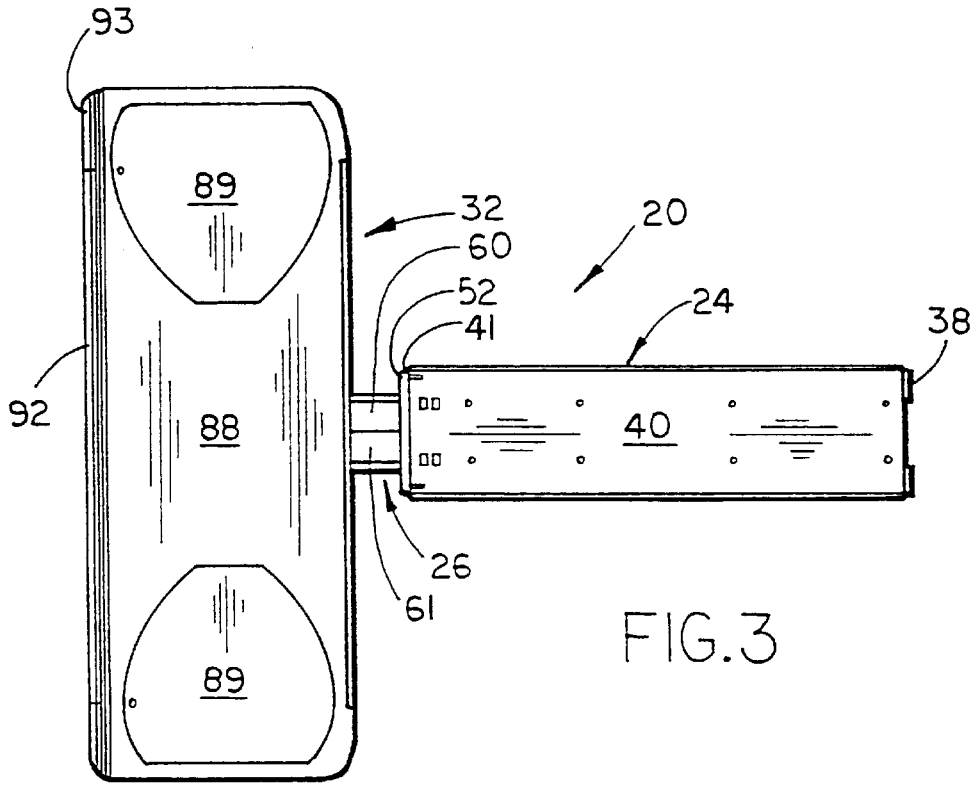
FIG. 3 is a top plan view of the invention shown in FIGS. 1 and 2.

For the purposes of the following description, the terms "upper," "lower," "right," "left," "front," "back," and relative terms of similar reference shall refer to the orientation of the invention as shown in FIG. 1. However, it is to be understood that the invention may assume various alternative orientations and configurations, except where expressly specified to the contrary. It is also to be understood that the specific embodiments of the invention described below and the methods or processes described and/or illustrated in the attached drawing figures, are simply exemplary embodiments of the inventive concepts as defined in the appended claims. Specific dimensions and other physical characteristics related to different embodiments are not to be considered as limiting, unless the claims expressly state otherwise.

The various embodiments of the adjustable support constituting the invention offer several advantages over other currently available devices. Due to the intuitive nature of its operation, stability, affordability, life cycle cost, and minimum number of parts, the support capabilities should be seen as beneficial to the perspective end user. It is preferred that this support device will completely retract underneath the worksurface to which it is mounted, allow height adjustability in order to accommodate different size users, swivel for user accessibility, and tilt for optimal usage angle. It will also accept a palm rest repositionable laterally and vertically by the user, and will support mousing activities in several ways. While these are common characteristics to many supports, the uniqueness of this product lies in its simplicity of use, particularly insofar as it operates on intuitive principals. Rather than requiring the user to operate a number of control knobs, handles, or levers to set the use height, which can be both difficult and confusing, the user simply needs to know where he or she would like to position the support. The user adjusts the height by simply tilting the platform upward about a pivot coupling to the arm, moving the platform to the desired height, and then releasing the platform. Upon release, the platform will securely remain in the position desired until it is repositioned by the user. Consequently, adjustment is not only made easier, but encourages the users to set the support at a comfortable location since the complexity normally inherent in these types of devices is eliminated.

A primary objective of the present invention is to offer superior functionality in a package that is easy for the user to both own and operate. This objective is achieved by providing an adjustable keyboard support which is substantially free of adjustment knobs and levers to properly position the keyboard support. As a result, the keyboard support position can be quickly and easily changed simply by raising an edge of the platform. Moreover, the primary objective is achieved by providing a basic support design having fewer moving parts than previous designs, which translates into improved functionality at lower cost.

Generally, and with reference to FIGS. 1–4, reference numeral 20 identifies one embodiment of an adjustable support assembly configured to receive and have located thereon a device 22, such as a computer keypad or keyboard, mouse, digitizing board, or the like, accessible by a user or operator. The adjustable support assembly 20 typically includes a base assembly 24 mounted in various ways to the underside or bottom surface 28 of a worksurface 30, such as a desktop, modular workstation component, or the like, and is configured to be connected to one end of an arm assembly 26. Attached to the opposite end of the arm assembly 26 is an adjustable platform or tray 32 which supports the keypad or other input device 22. The adjustable platform assembly 20 is configured to position the input device 22 at the desired height by the user, and includes a brake or locking assembly 34 (FIG. 4) to fix and hold tray 32 and arm assembly 26 at the desired vertical orientation with respect to the worksurface 30. Brake assembly 34 is engaged by the moment of tray 32 about the pivotal coupling at the second end of the arm assembly 26. Upward rotation of tray 32 about the pivotal coupling disengages the brake assembly 34, permitting the user or operator to move the tray to a different elevation.

Base assembly 24 includes an elongate track 40 having a generally C-shaped cross section defining downwardly depending channels 42 along the length thereof interconnected by a central web 43 preferably attached to the undersurface 28 of a workstation or desktop. Disposed in sliding relationship in track 40 is a U-shaped slide 44 having a pair of parallel arms 46 spaced from each other and interconnected by a central member 47. A generally rectangular opening 48 is defined in the inner faces of each arm 46, each adapted to receive a peripheral edge of a pivoting disk 49. Disk 49 is preferably circular having a depressed central region 50 relative to a circumferential flange 51 which is received in openings 48. Attached to the bottom of the depressed central portion 50 of disk 49 is a generally U-shaped bracket 53 having downwardly depending flanges 54. Flanges 54 are interconnected by a strap 55 along the top of the bracket. To prevent slide 44 from coming out of track 40, end 38 may be closed by metal flanges (not shown) while end 41 may be closed by a track front 52.

Pivotally attached between flanges 54 of bracket 53 is one end of an arm assembly 26. In a preferred embodiment, arm assembly 26 includes two halves 60, 61 each preferably cast from aluminum and configured to fit together to define a first end 62 and a second end 63 interconnected by a gently arcuate intermediate section 64. End 62 is preferably generally cylindrical in form and has defined therein at least one, and preferably two, cylindrical cavities 65, 66, one nested within the other. It is preferred that cylindrical cavities 65, 66 be concentric with each other about an axis oriented substantially perpendicular to the longitudinal axis of the arm 26. A hole 72 extending through end 62 along the axis of the cavities receives a pin or axle 72A to pivotally join end 62 to the base 24. To assist the user in raising arm assembly 26 and the associated tray and input devices, and to partially support the weight of these components, a torsion spring 73 is preferably disposed within cavity 66 wherein one end 74 is connected to the end 62 of the arm 26, and an opposite end 76 of the spring is connected to bracket 53. A second pin 58 may be fixed between flanges 54 and extend through an arcuate or crescent-shaped opening 59 extending through end 62. Pin 58 may provide the attachment point for the opposite end 76 of the torsion spring. Pin 58 is located eccentric and parallel to the pivot axis of end 62 and interacts with crescent-shaped opening 59 to limit the pivot angle of arm 26. Although it is preferred that arm 26 be cast from aluminum, it is contemplated that other materials and manufacturing techniques can be used, i.e., molding the arm from a polymeric material or the like.

Tubular arm 26 preferably has a reduced thickness, tapering from first end 62 to a desired thickness which extends in an arcuate fashion to second end 63. In a preferred embodiment, arm 26 also includes a passage 78 extending therethrough, which is connected to cylindrical cavity 66 at the first end 62, and terminates at an opening 79 at the second end 63. The passage 78 within arm 26 is characterized as curvilinear or circuitous, extending from an upper portion of cylindrical cavity 66 downwardly, and extending along a bottom portion of arm 26 where it rises sharply at end 63, extending around a cylindrical section 63A having a radius substantially identical to cylindrical cavity 66 at the first end 62. Although it is preferred that the radius of cylindrical section 63A and cylindrical cavity 66 be substantially the same, it may be desirable to make the radiuses dissimilar to change the characteristics of the support as will be described in greater detail below. Extending transversely through the second end 63 of arm 26 and concentric therewith is transverse opening 75 adapted to receive a pin or axle 71 for pivotally coupling the tray 32 thereto. The brake assembly 34 includes a flexible elongated brake element, such as a cable 81, which wraps partially around, preferably at least once, and most preferably twice, the inner wall 82. One end 83A of cable 81 is preferably fixed to bracket 53. An opening 84 is provided in end 62 to allow cable 81 to pass therethrough over the entire range of the arm rotation. The opposite end 83 of cable 81 extends the length of the passage 78 and is connected to the tray 32, as described below.

Although cable 81 is described as wrapping at least partially around inner wall 82 at end 62, basic functionality of the brake 34 can be achieved with only a small degree of angular wrap. The amount of wrap required is inversely proportional to the coefficient of friction between the braking element 81 and the inner wall 82. For a high coefficient of friction, cable 81 may only need to contact less than one-half the diameter of the drum 82. For lower friction coefficients, cable 81 may wrap at least once, and preferably no more than twice, around drum 82. Moreover, the cylindrical drum defined by inner wall 82 may be disposed at end 63 or in the intermediate portion 64 to achieve the same purpose. Furthermore, although arm 26 is described as having an arcuate or dog-leg configuration, arm 26 may also be straight. The curve or dog-leg configuration is preferred to accommodate the edge of the worksurface.

Attached to end 63 of arm 26 is tray assembly 32 which includes a bracket or subplatform 85 defined by a central web 86 and parallel, spaced apart downwardly depending flanges 87 pivotally connected to end 63. Attached to the top of web 86 is a generally rectangular platform or tray 88 configured to support a keyboard or other device thereon. In a preferred embodiment, subplatform 85 is connected centrally near the rear edge of platform 88, either by spot welds or other fasteners, such as nuts and bolts. In a preferred embodiment, tray 88 may be stamped or pressed from a sheet of sheet metal and includes bilateral depressions 89, each configured to receive a resilient mouse pad 90. The leading or front edge of the platform 88 preferably includes a U-shaped trough or channel 91 defined along the length thereof which is configured to receive a trim piece or trough filler 92 having a flange 92A received in trough 91. Trough filler 92 also provides a finished look to the leading edge. Attached below the leading edge is a belly pan 93 preferably molded from a polymeric material. In the preferred embodiment, belly pan 93 extends substantially the entire length of the leading edge to finish off the underside of the leading edge. Defined along the rear edge of platform 88 is a raised ridge 94C which acts as a barricade at the opposite edge.

In this embodiment, end 83 of cable 81 is fixed with respect to the subplatform 85. End 83 preferably includes a threaded termination configured to extend through a hole in flange 95 (FIG. 1) depending from web 86 of bracket 85. The location or position of the cable end 83 may be semi-permanently fixed using locking nuts or other types of fasteners. The tilt angle of tray 88 may be adjusted at the time of installation by changing either the coupling point of end 83 to subplatform 85, or by changing or adjusting the coupling point of the cable to the base. The attachment points may be made by way of set screws, pins extending through the end, or by other types of clamps or terminations. It is desired that bracket 85 and end 83 of cable 81 be concealed by a protective cover similar to belly pan 93 to provide a finished appearance as well as protect the user from any sharp edges or points associated with the cable termination and fixation. Similar results may be achieved by changing the length of the cable. For example, one technique is to use a turnbuckle or structure to attach the cable end to the platform, base, or both.

In operation, the assembly is assembled as described above, with the tilt angle of the platform established at that time by adjusting the length of cable 81 or coupling point of end 83 to bracket 85. In this configuration, the moment of the tray 88, bracket 85, and the accompanying input device places cable 81 in tension which, in turn, causes it to tighten around or against drum or wall 82. As mentioned previously, the amount of cable in contact with drum 82 varies inversely with the coefficient of friction between the cable 81 and drum wall 82. To adjust the height of the platform, the user simply lifts the leading edge such that the platform pivots about end 63 of arm 26 producing slack in cable 81 and releasing the brake or locking action. When in this configuration, the user is free to locate the tray at substantially any position, limited only by the pin passing through crescent-shaped opening 59. When at the desired elevation, the user lowers the edge of the platform to again place cable 81 in tension.

FIGS. 5–11 illustrate another embodiment of the invention based generally on the concept described above. Accordingly, the reader is referred to the above text for a description of the base and arm assemblies 24 and 26, respectively. The alternate embodiment of the adjustable support assembly 120 includes an adjustable subplatform or bracket 122 pivotally attached to the end 63 of the arm assembly 26. Subplatform 122 includes a central web 124 interconnecting two spaced apart and downwardly depending flanges 126 through which a pivot pin 71 extends as well as through end 63 of arm 26. Central web 124 also includes a tongue 130 terminating at its distal end 132 in a transverse groove 134 having a slot 136 extending through the tongue, the purpose of which will be described below. Also defined at the distal end 132 of the tongue is a downwardly depending flange 138 having an opening 140.

Attached to the upper surface of subplatform 122 is a T-shaped platform or tray 142 wherein the central web 124 is located proximate a rear edge 144 of the tray 142. Tray 142 is preferably stamped or die-pressed from sheet metal, but it is contemplated that tray 142 may be injection molded or manufactured using any other technique common in the industry. In a preferred embodiment, the upper surface of tray 142 contains a generally central depression 146 extending from the rear edge 144 at the base of the "T," substantially to the leading edge 148 (see FIG. 9). Parallel elongate, spaced apart slots 150 are formed in the bottom of the depression for the purpose of receiving a keyboard clamp assembly 152 retained by fasteners extending through slots 150 to permit translation of movement of the clamp assembly with respect to leading edge 148. Extending from an upper surface of clamp assembly 152 is a post or wall 153 configured to retain a resilient bumper 155 provided to engage a rear edge of the keyboard or other input device to tightly hold the device against the leading edge. It is also contemplated that clamp assembly 152 may be spring loaded such that the bias force exerted by the springs clamps the keyboard in position, but the keyboard can quickly and easily be moved or removed. Attached to the leading edge 148 of platform 142 is a palm rest support assembly 154 including a base support 156 received in U-shaped trough 158 defined along the leading edge. As shown in greater detail in FIG. 9, base support 156 includes a flange 157 received in trough 158. A latch 159 extending from the upper edge may be formed having a detent 161 adapted to engage a window 163 extending through a wall of the trough. Using this or a related structure, base support 156 is securely retained in trough 158, but may be easily removed. The upper edge of base support 156 also includes at least one and preferably two posts 156A preferably containing a resilient material, and configured to engage the edge of the device opposite that in contact with clamp assembly 152. Depending from the upper edge and adjacent trough 158 is one and preferably two coplanar flanges 156B, each containing a vertical slot 156C for reasons which will become apparent below. Defined parallel along the upper terminus of flanges 156B, is a horizontal channel 156D configured to slidably receive therein an upper flange 160A of a slide 160. A pair of inclined slots 162 are formed in the face or downwardly depending body of slide 160, each slot inclined in the same direction at the same angle, and appropriately spaced apart so as to overlap vertical slots 156C in base support 156. The inclined slots 162 of slide 160 each receive a boss (not shown) extending from a palm rest pad support 164 which, in turn, supports a palm rest pad 166. Fasteners are provided which extend through vertical slots 156C and into the bosses received in inclined slots 162. The height of palm rest pad 166 is changed by moving the slide either left or right along channel 156D such that inclined slots 162 vertically move the bosses in a camming direction. If the adjustable palm rest assembly is not preferred, it may be removed in its entirety by moving the latch lever and pulling the assembly off. A trough filler, or similar structure, as described above, may be used to finish the leading edge.

Figure 8:
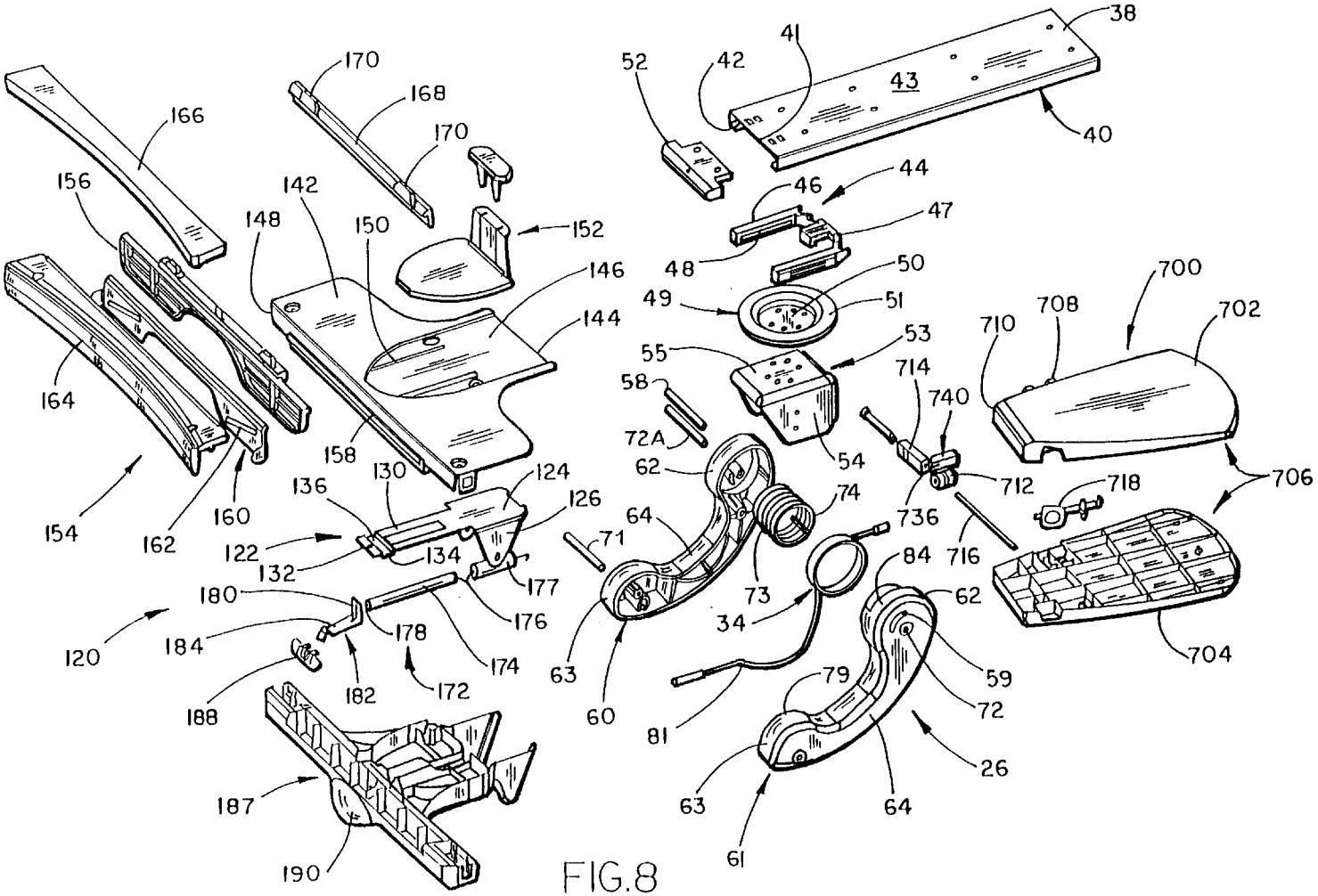
FIG. 8 is an exploded view of the invention shown in FIGS. 5–7.
Figure 9:
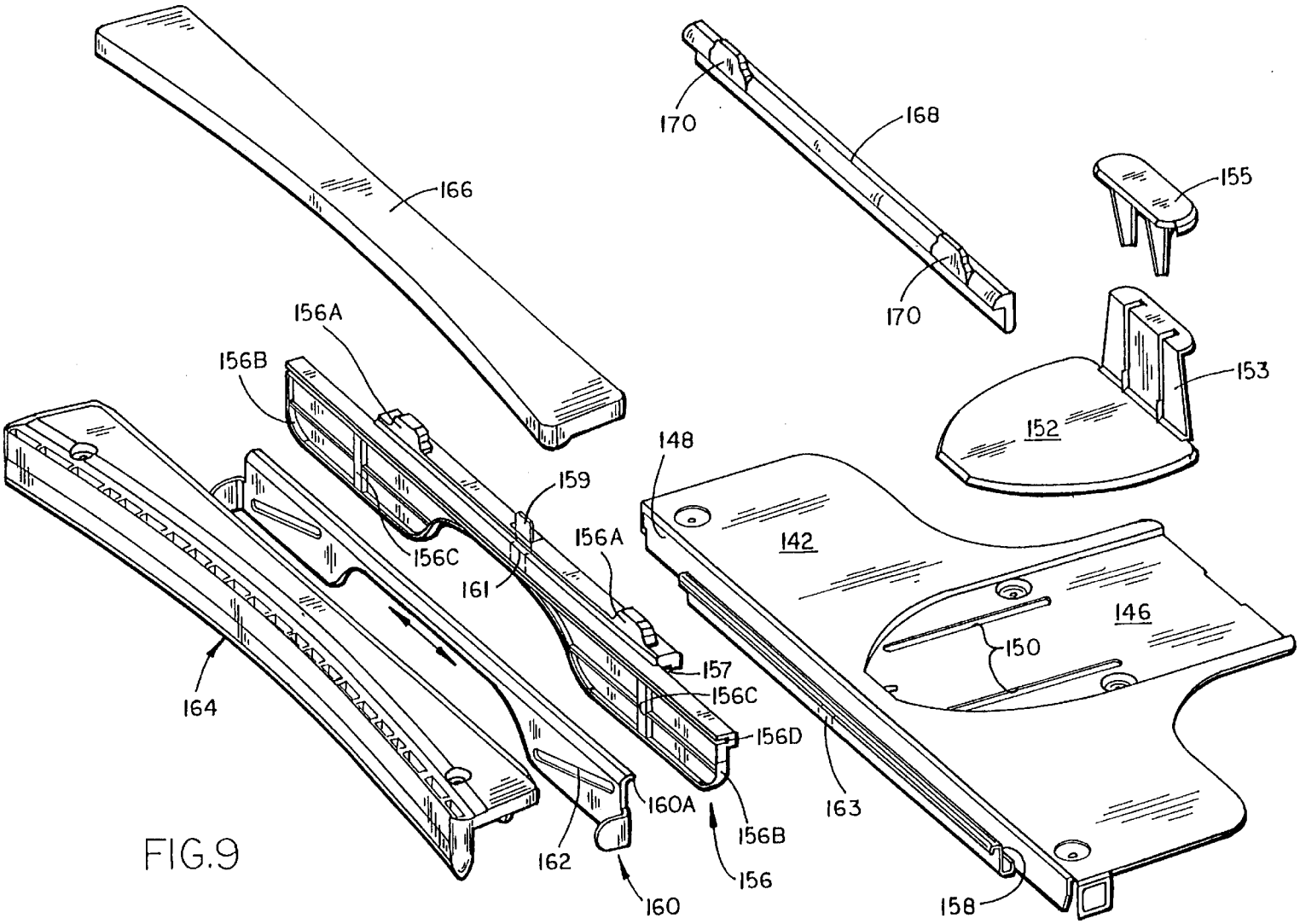
FIG. 9 is an enlarged exploded view of FIG. 8, illustrating the tray, keyboard clamp, and the movable palm rest assembly.
Figure 10:
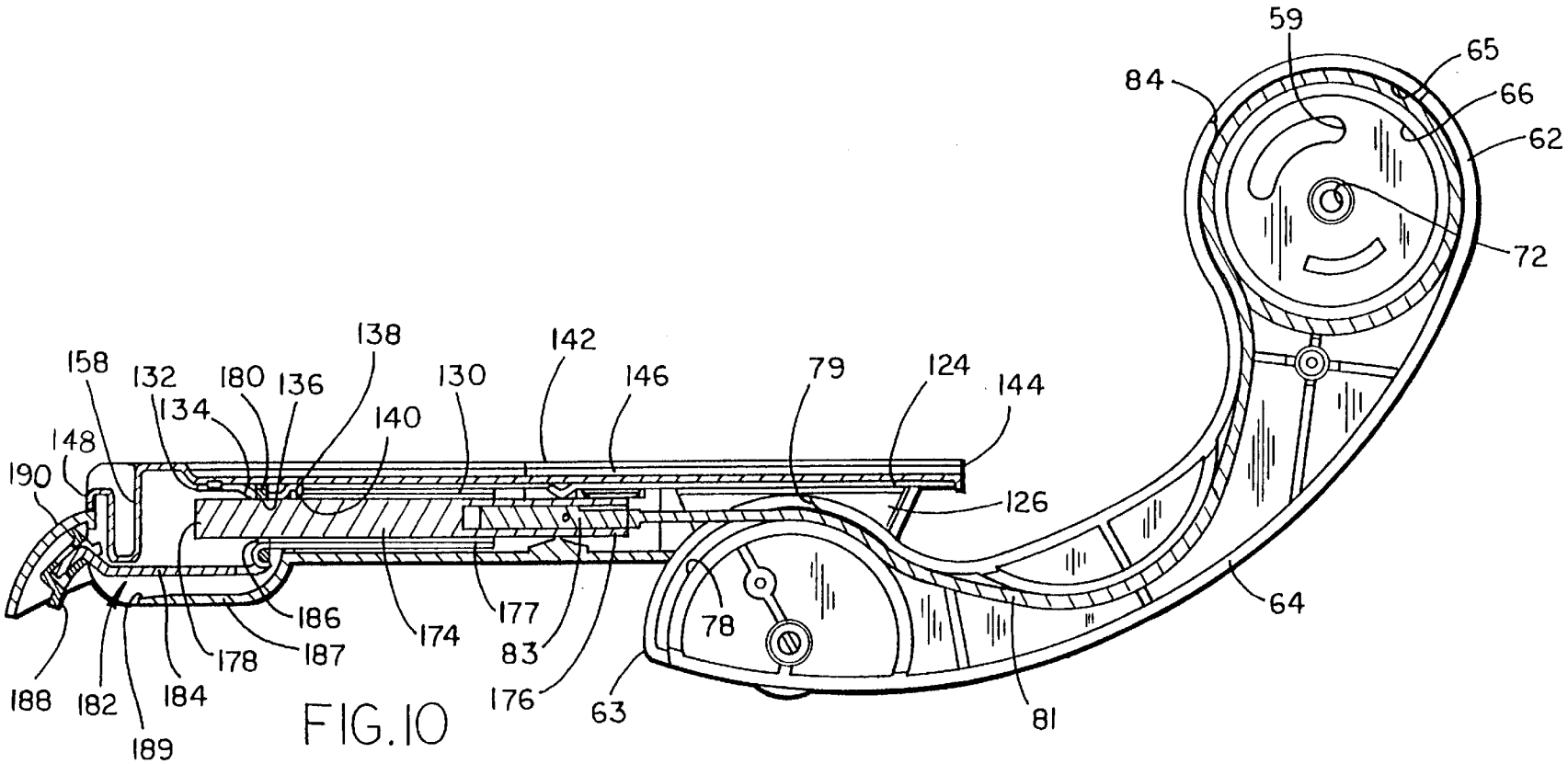
FIGS. 10 and 11 are section views of the invention illustrating the action of a tray tilt adjustment mechanism.
Figure 11:
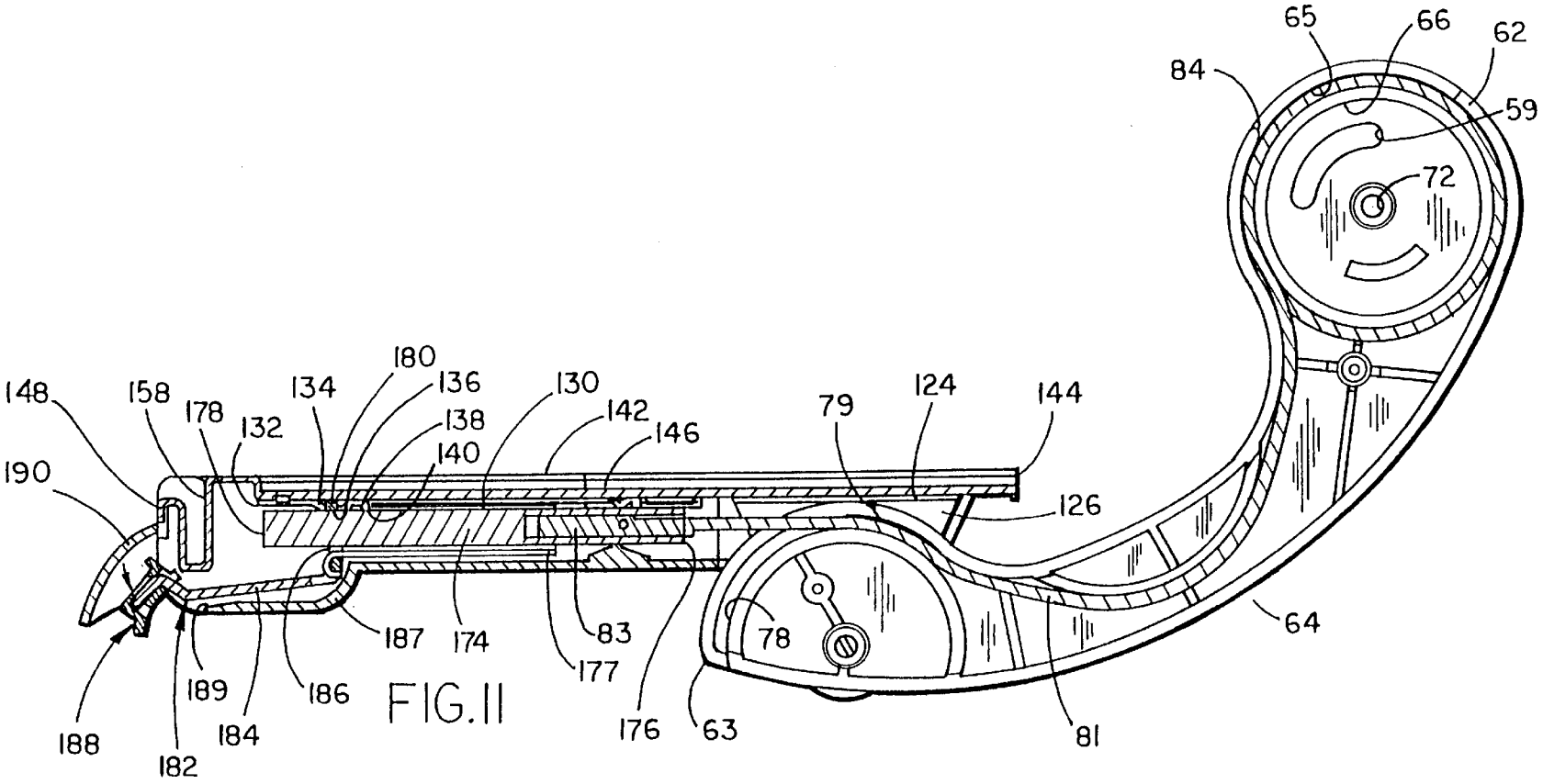

Attached to subplatform 122 and located beneath tray 142 is a tray tilt adjustment mechanism 172 for changing the angular orientation of tray 142 with respect to arm assembly 26 and base assembly 24 (see FIGS. 8, 10, and 11). In this embodiment, mechanism 172 includes a tilt rod 174 open at end 176 to securely receive and retain the end 83 of cable 81 therein. In turn, end 176 of rod 174 is concentrically received by a tension spring 177 having one end attached to end 176 of rod 174, and the opposite end attached to a lever 182 described below resulting in a constant tension being applied to cable 81. The opposite end 178 of rod 174 is received through the opening 140 in flange 138. Also received over end 178 of rod 174 is one leg 180 of an L-shaped lever or grabber 182, briefly mentioned above, wherein the end of leg 180 is retained in the slot 136 extending through groove 134 described above. The other leg 184 of the lever extends generally parallel to rod 174 and terminates proximate the leading edge 148 of the tray. The opening 186 in leg 180 receiving rod 174 is such that when leg 180 is perpendicular to rod 174, the rod is free to slide with respect to lever 182. However, as a result of the tension applied by spring 177, leg 180 is biased at an angle with respect to rod 174 such that opening 186 binds against and retains rod 174 in position. The binding of lever 182 on rod 174 is released by moving leg 184 substantially parallel to rod 174.

Attached to the bottom of tray 142 is a belly pan 187, substantially concealing subplatform 122, tilt adjustment mechanism 172, and end 63 of arm 26. In general, pan 187 has a T-shaped configuration to conform to tray 142. A leading edge of the pan is configured to underlie the trough 158 as well as a portion of the palm rest assembly 154. A hole 189 is provided such that a portion of lever leg 184 can extend partially therethrough. To provide a finished appearance as well as an ergonomic means of actuating the lever, a button 188 is attached to the end of leg 184 through hole 189. In the preferred embodiment, a spherically shaped segment forming a handle 190 is provided on the leading edge of the belly pan to enable the user to retract and extend the adjustable support assembly as well as to partially conceal button 188.

In the embodiment shown in FIGS. 5–11, the elevation of the tray or keyboard support 142 is accomplished much in the same manner as described in reference to FIGS. 1–4. Normally, the moment of tray 142, and any device resting thereon, places the cable extending through the arm and in contact with the lock drum under sufficient tension such that the lock drum is fixed in space preventing the arm from moving. To change the height of the platform 142, the user need only lift the leading edge, rotating the tray about the pivot point with the second end of the arm. The rotation about the pivot point produces slack in the cable which, in turn, releases the lock drum, permitting the user to either raise or lower the arm and attached tray. Once at the desired elevation, the user simply lowers the tray to reapply tension on the cable. As a result of the cable length being substantially fixed, the angular orientation of the tray 142 relative to the base or worksurface remains constant with changes in elevation of the tray. If it is desired to change the angular orientation of the tray, the user simply depresses button 188 upward to move leg 180 substantially perpendicular to tilt rod 174. In this orientation, leg 180 no longer binds on tilt rod 174, and the tray can be adjusted to the desired angle. Spring 177 interconnecting lever leg 180 to the end of tilt rod 174 maintains tension on cable 81 to maintain the elevation of tray 142. Once the tray has been adjusted, the user releases button 188. Spring 177 biases lever leg 180 back into a position to bind against tilt rod 174. In another embodiment, two springs can be used to accomplish the same task.

With respect to the upper surface of the tray, the user can adjust the height to the palm rest quickly and easily by moving the slide 160 left or right. The inclined slots in the slide engaging the bosses on the palm rest translate horizontal motion into vertical motion. Appropriate friction between the sliding components will hold the palm rest at the appropriate height.

The user can also fix or remove the input device from the upper surface of the tray by sliding the keyboard clamp either toward or away from the device. It is contemplated that a fastener could be provided extending through the top of clamp 152 and into a slot formed in the platform to securely retain the clamp in position. Additionally, the clamp may be attached to springs biasing the clamp in a closed position.

Figure 14:
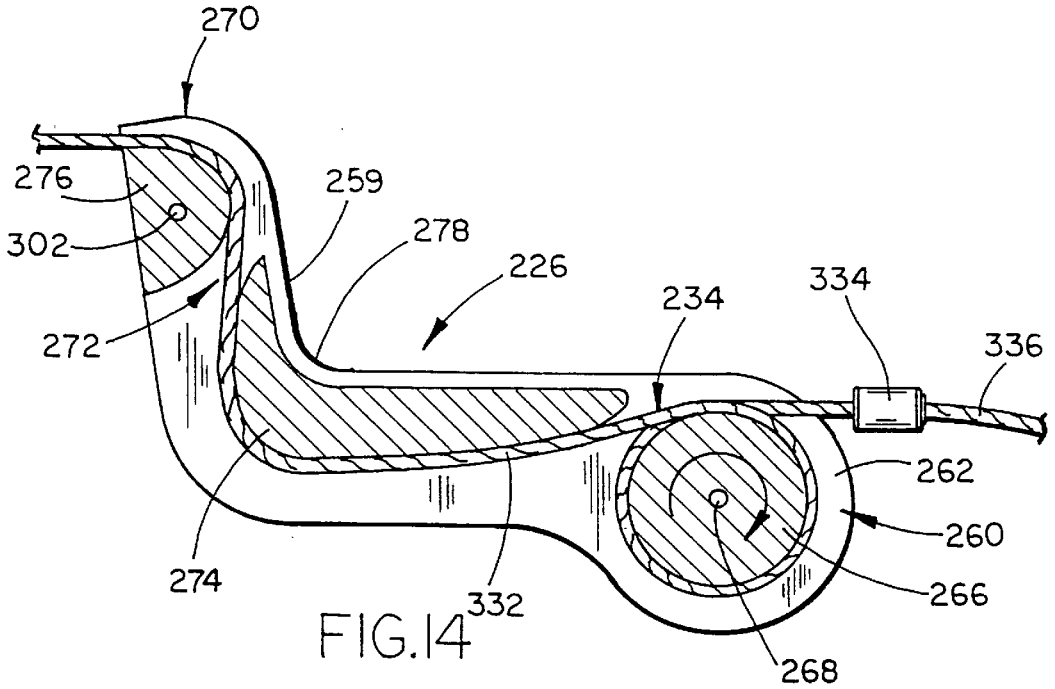
FIG. 14 is a fragmentary section view of the invention taken along line XIV—XIV in FIG. 13.
Figure 12:
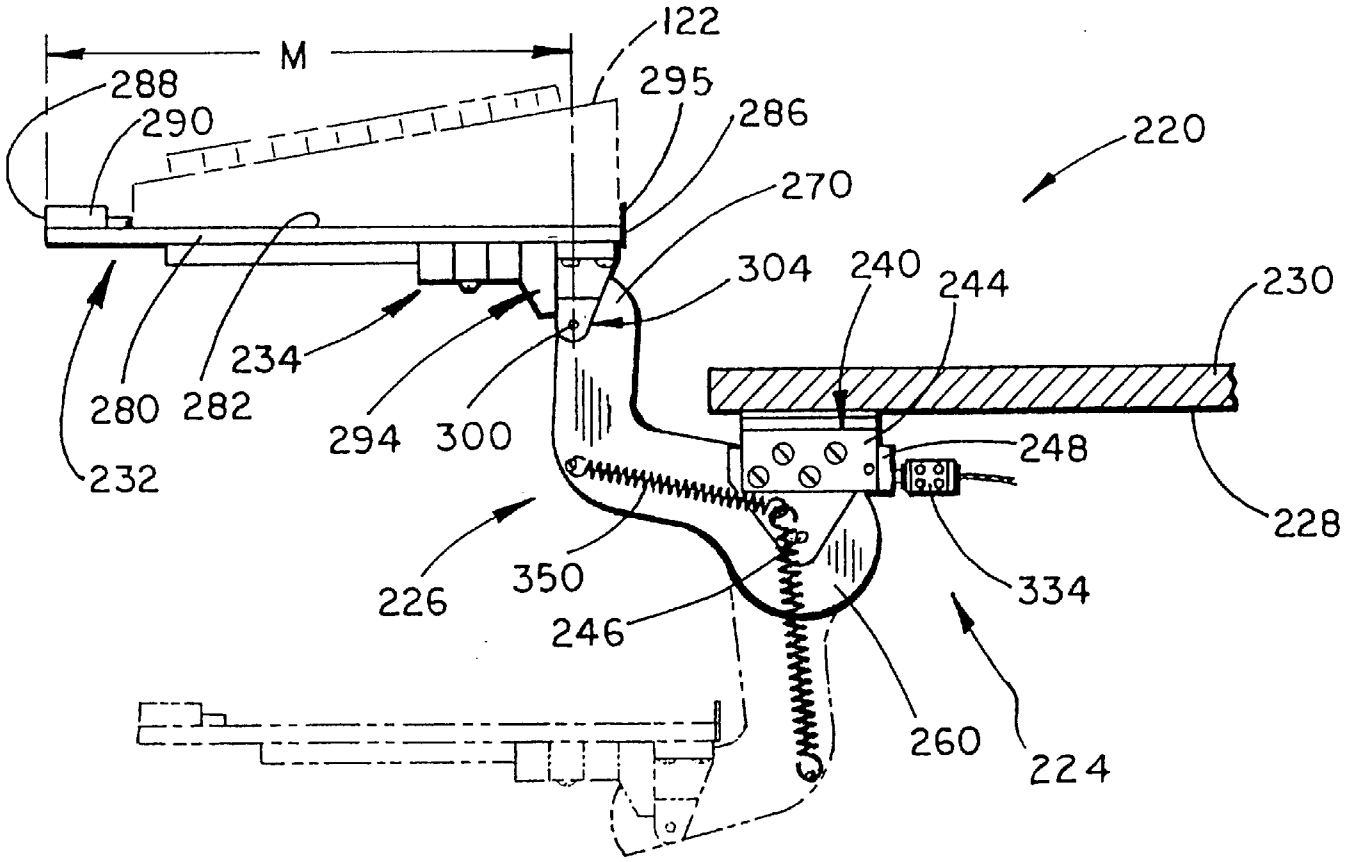
FIG. 12 is a side elevation view of another embodiment of the invention.
Figure 13:
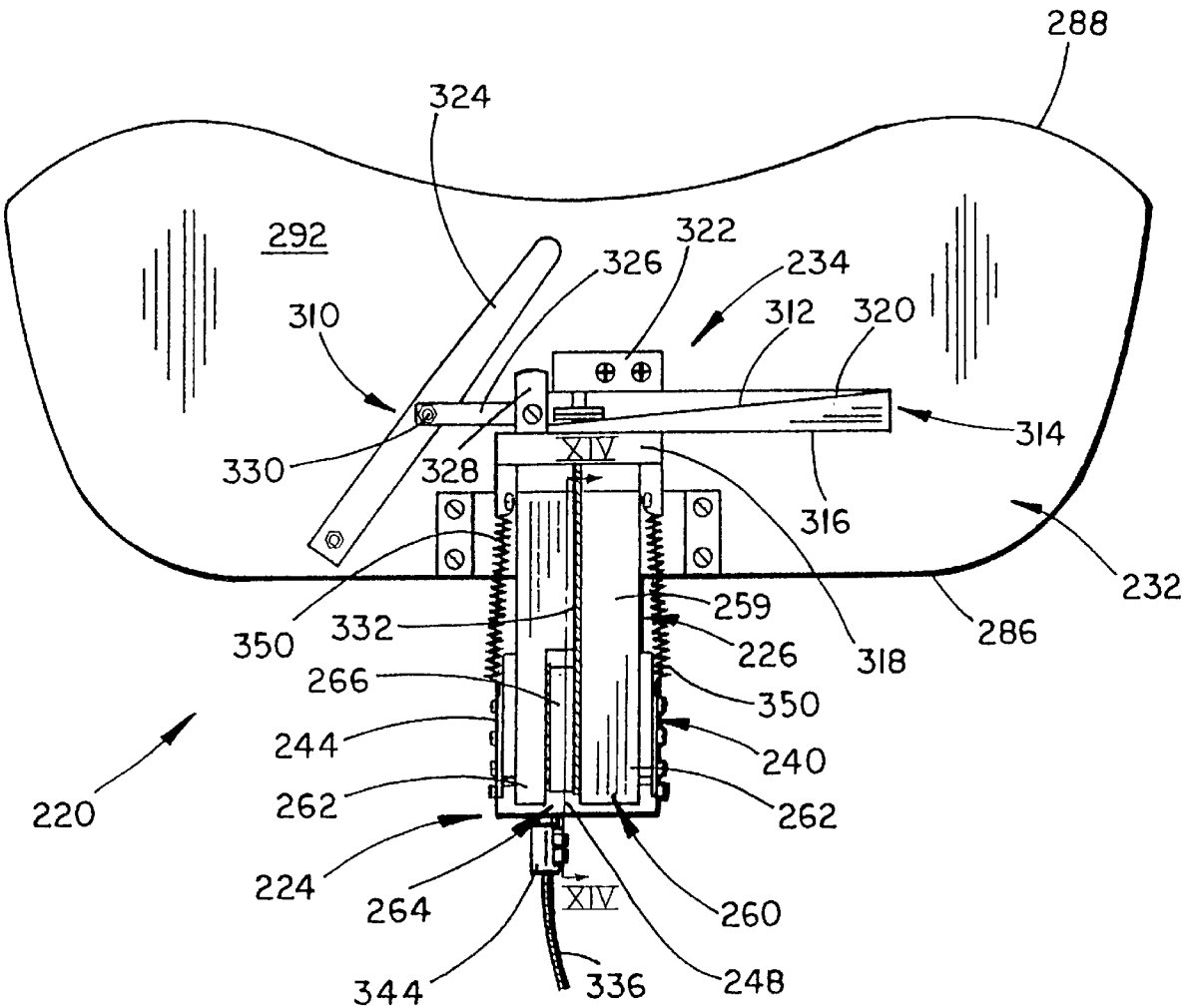
FIG. 13 is a bottom plan view of the invention shown in FIG. 12.

FIGS. 12–14 illustrate another embodiment 220 of an adjustable support assembly embodying the invention. As in the previous embodiments, assembly 220 is configured to support a data input device 222, such as a computer keyboard or the like, and includes a base assembly 224 connected to one end 260 of an arm assembly 226. The base assembly is preferably mounted to the underside or bottom surface 228 of a worksurface 230, such as in the manner described above. Attached to the opposite end 270 of arm 226 is an adjustable platform or tray 232 which supports device 222. The adjustable platform assembly 220 is configured to position the device 222 at the desired height and angular orientation selected by the user and includes a locking assembly 234 to fix and hold tray 232 at the desired angular orientation with respect to worksurface 230.

Figure 15:
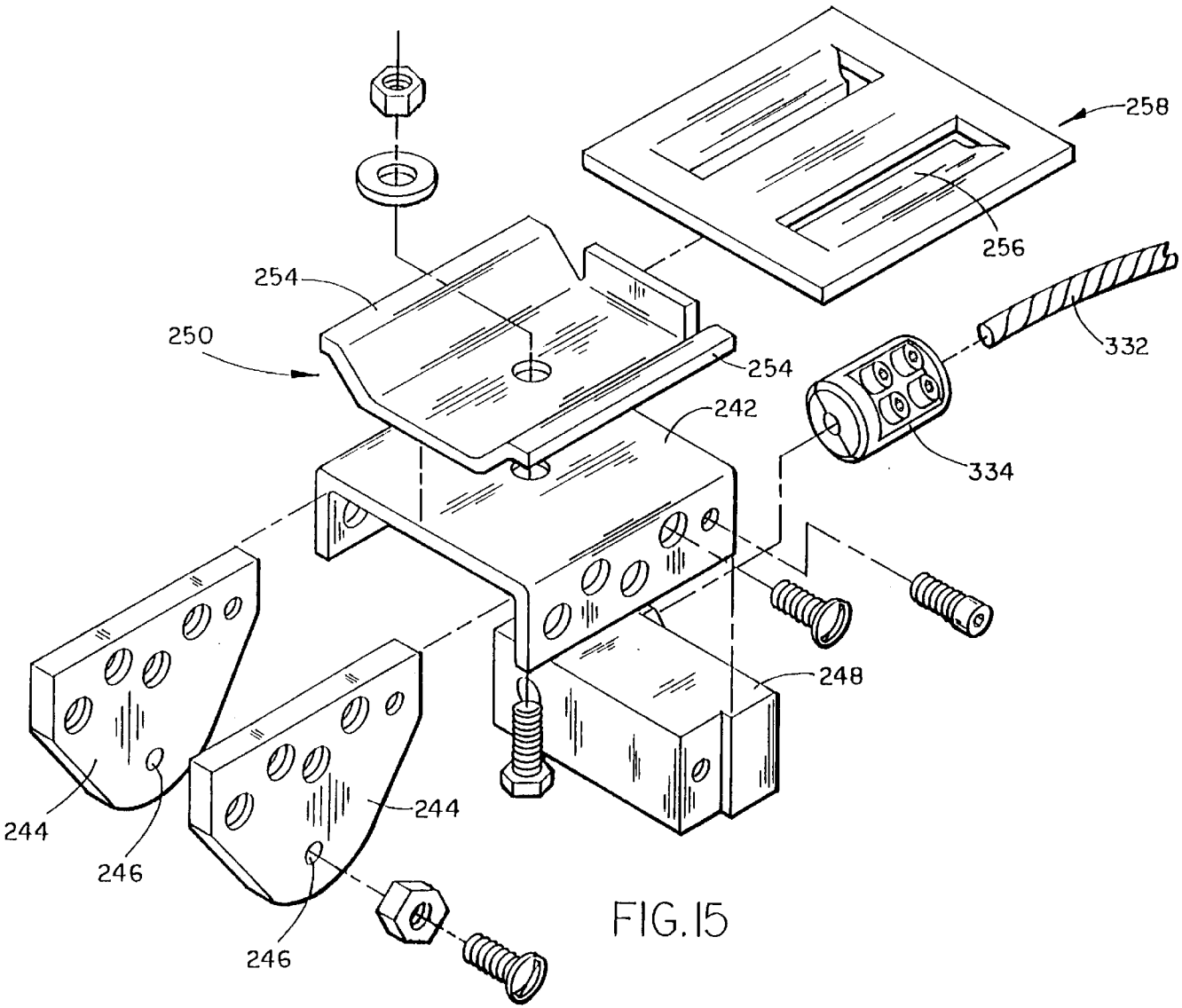
FIG. 15 is an exploded view of a base assembly of the invention shown in FIGS. 12–14.

As shown in the drawings, base assembly 224 includes a generally U-shaped yoke or bracket 240 having a central web 242 and downwardly depending parallel flanges 244 at opposite ends. Each flange preferably includes a hole 246 passing therethrough in axial alignment with the other. Extending along a rear edge of bracket 240 proximate web 242 and interconnecting flanges 244 is a back rail or block 248. If it is desired to provide translational movement of bracket 240, a slide 250 (FIG. 15) may be pivotally coupled to web 242. Alternatively, ends 254 of slide 250 may be upturned slightly to define a pair of bearing surfaces, each of which are configured to be received in a corresponding channel or track 256 defined in a mounting plate 258 secured to the undersurface 228 of the worksurface 230. The positioning of the ends 254 in the channels 256 allows slide 250 to translate back and forth therein. The pivotal coupling of slide 250 to web 242 also permits bracket 240 to rotate about a vertical axis with respect to slide 250 and mounting plate 258. Other means for providing translational movement of bracket 248 may be provided other than described above, including drawer glides or similar tracking arrangements. One example may be found in a computer keyboard support available from Steelcase Inc., of Grand Rapids, Mich., and designated Model W99274A.

Pivotally attached to bracket 240 and forming a joint through holes 246 in flanges 244 is one end 260 of arm assembly 226, briefly described above. Arm assembly 226 may be a substantially solid or rigid tubular arm member 259 preferably having a shape ranging between a straight arm, a C-shape, and an L-shaped configuration. In one embodiment, end 260 of arm 259 is divided vertically to define two spaced apart fingers or flanges 262 separated or spaced from each other by a gap 264. Disposed within gap 264 and securely attached to flanges 262 and concentric with holes 246, is a cylindrical locking member or drum 266. A pin or axle 268 is provided through holes 246 to journal the first end 260 and drum 266 thereon for pivotal rotation of arm 259 thereabout. Pin 268 may be removed in the event the adjustable platform assembly 220 requires servicing.

Between end 260 and an opposite end 270 of the arm 259 (FIG. 14), and defined therein, is a curvilinear or circuitous passage 272 generally conforming to the configuration of the arm assembly. In the embodiment shown in the FIG. 14, passage 272 is defined by arcs or circular segments 274 and 276. Arcuate bodies 274, 276 are disposed in the interior of arm 259, with segment 274 located adjacent the inside bend 278 or inner portion of the elbow. In a similar fashion, segment 276 is located proximate second end 270 to define a radius opposite to that defined by segment 274. In a preferred embodiment, the radius of segment 276 is substantially the same as the radius of lock drum 266. In a working embodiment of the adjustable support, arm 259 contains two circular segments or members 274, 276 positioned therein to define passage 272, each having the same radius as lock drum 266. Member 274 has generally a three-quarter circular shape with its center located approximately at the inner elbow 278 of the arm 259. Member 276 is approximately semi-circular in shape having its center located inwardly from end 270. In the working embodiment, the diameter (Ø) of the lock drum 266 and the two members 274, 276 is approximately 3⅞ inches. Although circular member or segments 274, 276 and drum 266 are disclosed as defining circuitous passage 272, other means may be used to achieve substantially the same results including a series of pulleys or angular members.

Figure 16:
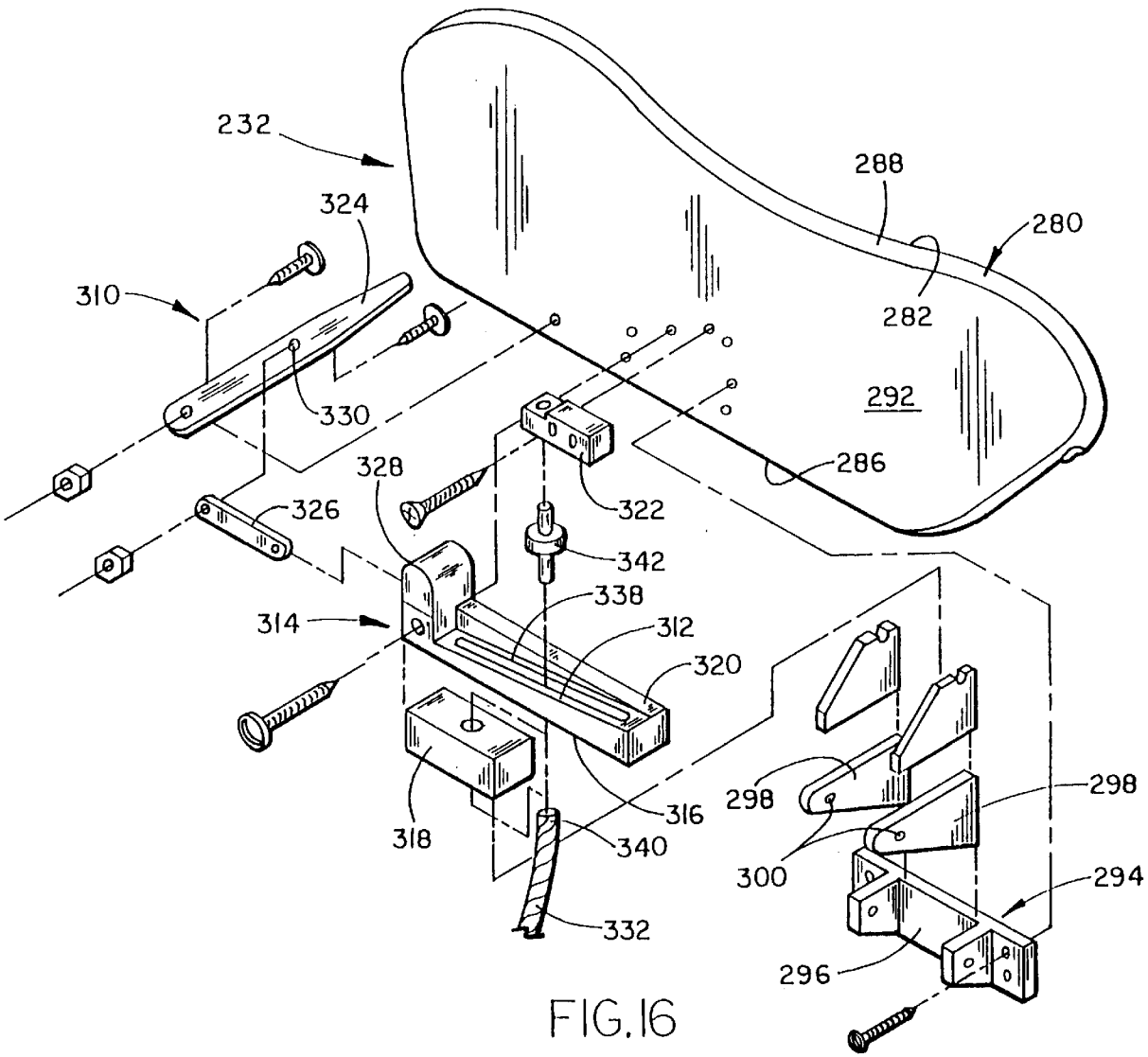
FIG. 16 is an exploded view of a platform assembly of the invention shown in FIGS. 12–15.

Pivotally coupled to the second end 270 and forming a joint with arm 259 is the platform or tray assembly 232. As seen in FIGS. 12, 13, and 16, platform assembly 232 includes a generally rectangular table or tray 280 having an upper surface 282 configured to support a computer keypad, keyboard, mouse, digitizing pad, or the like, for easy access by the user. A flange or stop 295 may be attached to a rear edge 286 of the tray. While proximate the forward edge 288, the tray 280 may contain or support a resilient pad or support surface 290 to pad the user's palms. It is contemplated that table, tray, or platform 280 may have any one of a number of configurations, including generally rectangular or a more ergonomic angular shape to accommodate split keyboards. It is preferred that tray 280 be large enough or have an adjustable width to accommodate a wide range of input devices including notebook sized personal computers and the like. It is also contemplated that tray 280 be configured to receive accessories dependant therefrom including a foldable or detachable mouse pad, as described below.

Attached to an undersurface 292 of tray 280 proximate the rear edge 286 is a U-shaped bracket 294 having a central web 296 and a pair of downwardly depending flanges 298 each extending from or proximate an opposite end of web 296. Extending through the distal end of each flange is a hole 300 configured to align with a similar hole defined in the second end 270 of the arm 259, and receive a pin or axle 302 such that the tray is pivotally joined to end 270 of arm 259. Attached to U-shaped bracket 294 on a side opposite rear edge 286 is a tray tilt adjustment mechanism 310 to change the angular orientation of tray 280 with respect to base assembly 224. The adjustment device 310 includes, in one embodiment, a wedge or ramp 312 defined along a length of bar or strap 314. A straight edge 316 of bar 314 lies adjacent plate 318 interconnecting flanges 298. Adjacent an opposite edge 320 of bar 314 is a keeper 322 designed to retain bar 314 in sliding relationship against plate 318. Bar 314 is translated left and right by a lever 324, having one end pivotally coupled to the underside 292 of tray 280 proximate the rear edge 286. A link or yoke 326 pivotally interconnects end 328 of bar 314 to a point 330 intermediate on lever 324.

Interconnecting tilt adjustment device 310 to base assembly 224 is an elongate flexible locking or brake element 234 mentioned above, including a cable, rope, or metal band 332 acting as a load supporting member passing through the curvilinear passage 272. In particular, cable 332 extends from a clamp or fitting 334 (FIGS. 14 and 15) on the back side of bracket 248 which securely fixes end 336 of the cable 332 to base assembly 224. Cable 332 extends through an opening in bracket 248 and has at least a portion in contact with drum or cylindrical member 266. In one embodiment, braking cable 332 wraps at least once, and preferably twice, around drum or cylindrical member 266 starting at a point along the upper portion of the drum 266. Cable 332 continues around drum 266 in a spiral fashion such that it never crosses itself. From drum 266, cable 332 extends through circuitous path 272 around and engaging the radiuses circumscribed by members 274, 276 before exiting second end 270 of arm 259. From end 270, element 332 passes through a hole defined in plate 318 and through an elongated slot 338 defined in and extending through ramped surface 312 and surface 316. Second end 340 of element 332 passing through ramped surface 312 of bar 314 receives a fitting 342 secured thereto which prevents element 332 from being withdrawn through slot 338. In this configuration, the coupling or attachment point of tray 280 to second end 340 of element 332 is generally toward the central portion of the tray. Because the joint 304 (FIG. 12) of tray 280 to end 270 of arm 259 occurs proximate the rear edge 286, tray 280 creates a substantial moment (M) or load about the pivotal coupling 304. As a result, when tray 280 is in a resting or generally horizontal orientation, the moment (M) results in substantial tension force on element 332 through passage 272 and around drum 266 such that the friction of element 332 against drum 266 locks drum 266 and arm 259 in place with respect to base assembly 224. Upward rotation of the forward edge 288 of tray 280 about joint 304 releases the tension on cable 332 which, in turn, reduces the friction with drum 266, such that arm 259 may be rotated up or down with respect to base assembly 224.

It is not absolutely necessary that cable 332 wrap around drum 266 or even around a major portion of the drum. Basic functionality of the brake assembly can be achieved with only a small degree of angular wrap. The amount of wrap required to achieve full functionality is inversely proportional to the coefficient of friction between the cable 332 and drum 266. There is no absolute minimum wrap that can be defined. With high friction, significant counterbalancing, and minimal loading, a small angular wrap may be adequate.

Instead of cable 332 tightening against lock drum 266 to hold arm 259 in position, other means may be used. It is contemplated that a clutch mechanism may be used to fix the angular orientation of arm 259 engaged and disengaged by cable 332. Friction may be enhanced by providing interlocking grooves on the mating surfaces of the clutch components. Additionally, a brake system, similar to that used on the wheels of vehicles, may be used wherein one or more brake shoes or pads engage a drum or disk attached to end 260 of arm 259. These and similar structures are contemplated to be within the scope of the invention.

All of the components comprising arm assembly 226 and platform assembly 232 themselves create a significant moment with reference to base assembly 224, such that some users may find it inconvenient or cumbersome to raise or lift the arm and tray assemblies 226, 232 to a new position. To assist in raising the arm and tray assemblies, and to prevent the entire assembly from dropping or falling away from the user with the release of the locking or brake mechanism, at least one bias member or spring interconnects arm assembly 226 to base assembly 224 to produce an upward force on arm assembly 226. In the embodiment shown in FIGS. 13–16, it is contemplated that one, and preferably two tensional springs 350, interconnect arm assembly 226 to an upper portion of base assembly 224.

The angular orientation of tray 280 with respect or reference to the worksurface may be changed. It is contemplated that with element 332 in tension, the user may change the angular orientation of tray 380 by moving lever 324 either toward or away from the tilt adjustment assembly. As seen in FIG. 13, movement of lever 324 toward the outside or end of tray 280 pulls bar 314 such that fitting 342 moves up ramped surface 312, thus moving the forward or leading edge 288 of tray 280 upward. During the adjustment as just outlined, the moment created by tray 280 on element 332 creates sufficient tension to maintain the angular orientation of arm 259. Tension of element 332 about drum 226, of course, increases once the user rests his or her hands on the forward edge 288 or the resilient pad 290.

Figure 17:
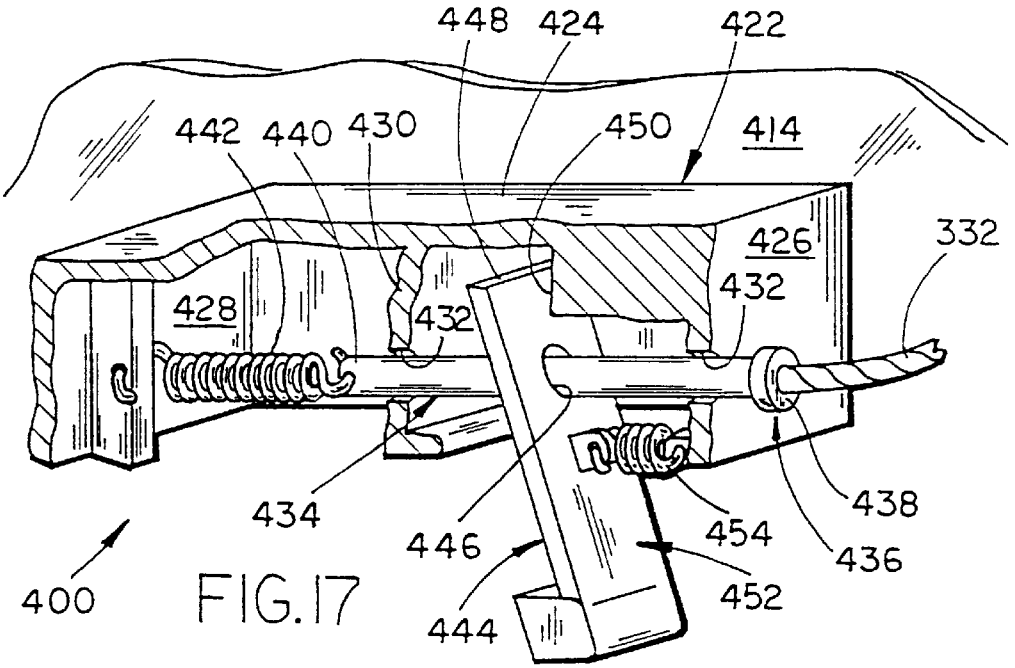
FIG. 17 is a perspective view of one embodiment of a tilt adjustment device to be used with the invention.
Figure 4:
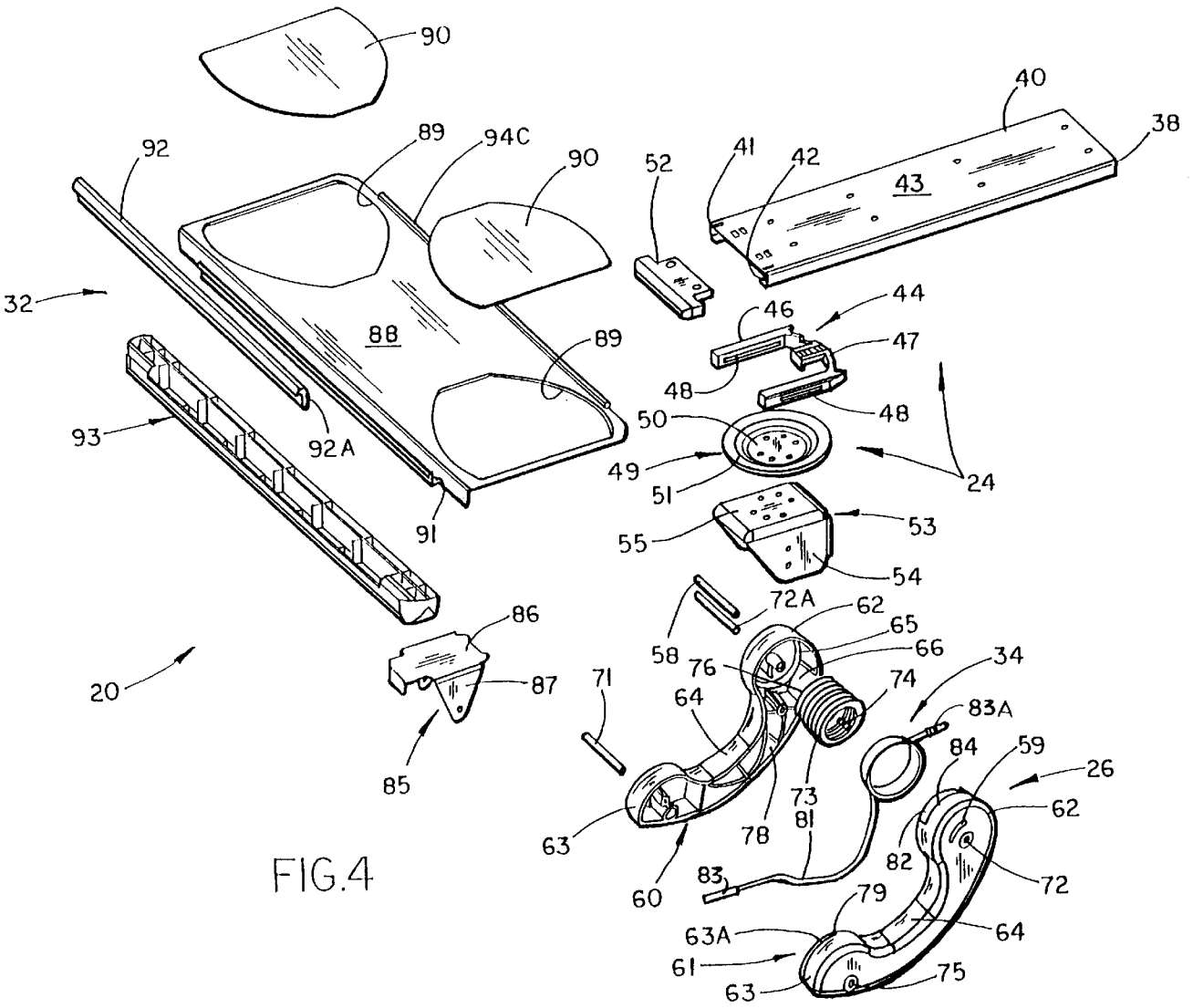
FIG. 4 is an exploded view of the invention shown in FIGS. 1–3.
Figure 5:
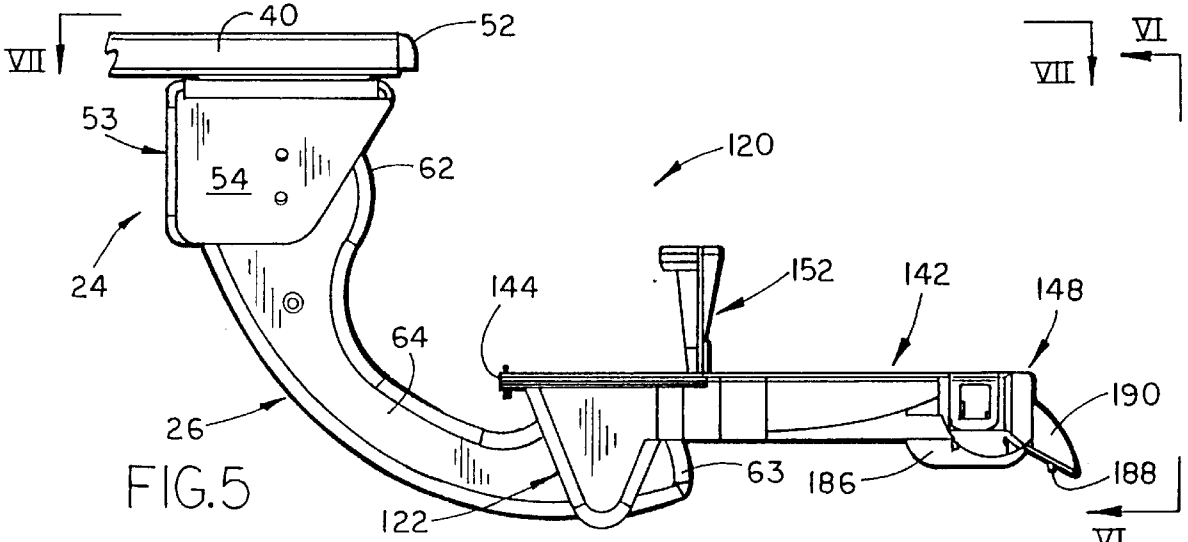
FIG. 5 is a side elevation view of an alternate embodiment of an adjustable support embodying the invention.
Figure 6:
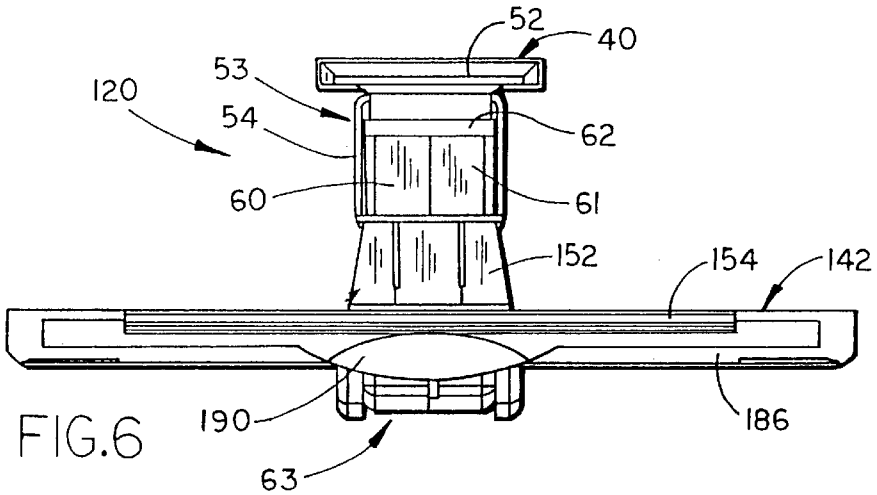
FIG. 6 is a front elevation view of the invention shown in FIG. 5.
Figure 7:
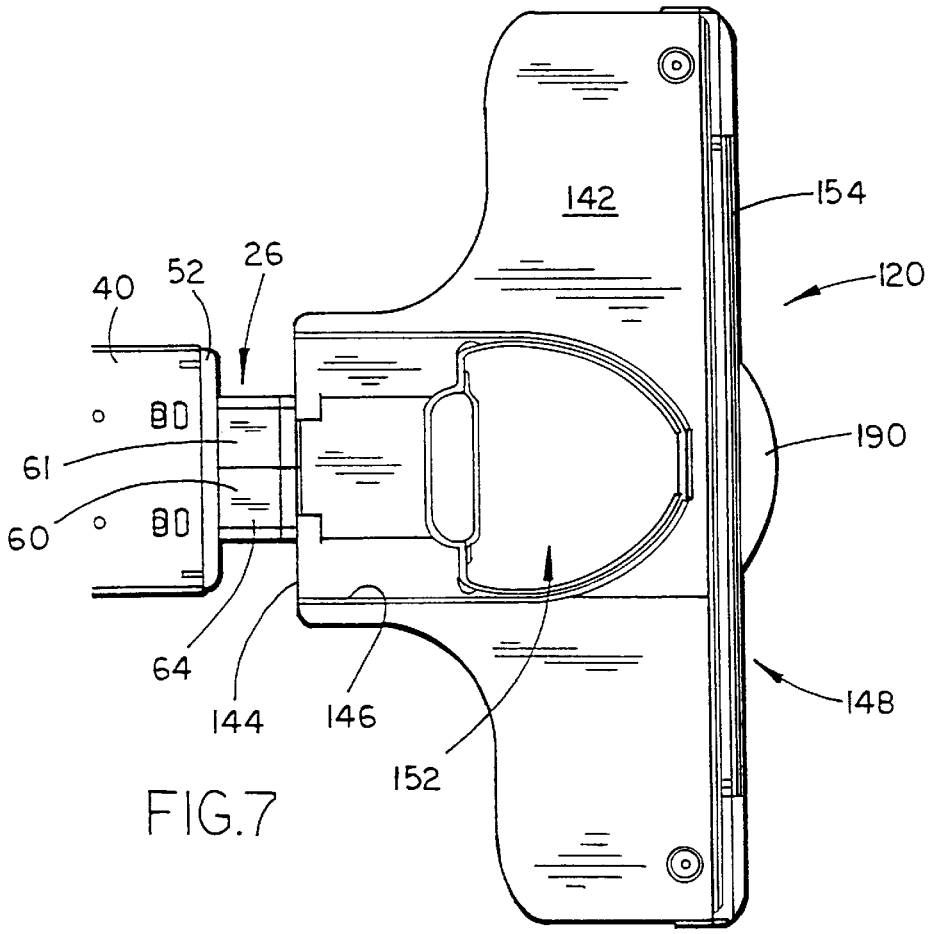
FIG. 7 is a top plan view of the invention shown in FIGS. 5 and 6.

An alternate embodiment 400 of the tilt adjustment mechanism for the tray is shown in FIG. 17. In this embodiment, the support includes a base pivotally mounted at one end of the arm assembly. The base assembly includes a bracket mounted to a plate, such as described above, in sliding relationship to a substrate, such as the underside of a desk or computer stand. Attached to the opposite end of the arm assembly is a platform assembly which is configured to support an input device and to provide adjustable configurations to suit the particular user. A brake or locking assembly is also provided to fix the angular orientation of the arm with respect to the base. The following discussion will focus on the tray 414 and related structures. For the purposes of this embodiment, the above descriptions of base, arm, and brake assemblies may apply equally as well here, although it will be readily apparent to those skilled in the art that other structures or assemblies may be used.

Referring again to FIG. 17, attached to the undersurface or bottom of the tray 414 proximate the back edge is a yoke, bracket, or other pivotal coupler, such as described above, configured to pivotally couple with the second end of the arm thereto. As with the first end, a number of pivotal couplers may be used. Located adjacent the tray coupler or integral therewith, and on a side opposite rear edge of the tray 414 is a tilt adjustment mechanism or assembly 422. In this embodiment, assembly 422 includes a frame 424 having a first wall 426, a second opposite wall 428, and an intermediate wall 430. Extending through walls 426, 430 and coaxial with each other are holes 432 adapted to receive a pin or termination fitting 434 in sliding relationship therein. One end 436 of the pin has a flange 438 to prevent the pin from passing through wall 426. The opposite end 440 of the pin 434 extends through wall 430 and is connected by a tension spring 442 to wall 428. Disposed between walls 426, 430 is a lever 444 having a hole 446 through which pin 434 passes. End 448 of the lever 444 engages a shoulder 450 extending from frame 424 while an intermediate portion 452 of the lever 444 is coupled by a second spring 454 to the upper portion of wall 426. With lever 444 oriented substantially perpendicular to pin 434, the pin may slide freely through holes 432 and 446 limited only by flange 438 and the tension applied by spring 442. With the lever 444 inclined away from the perpendicular with respect to pin 434, the pin binds in hole 446 and is retained in place.

Pin 434 is connected to an elongate flexible locking element, such as the length of cable mentioned above. In this embodiment, the cable extends from the pin into an opening in the second end of the arm, around the radiused path, and at least partially around the outer wall of the cylindrical drum. The second end of the cable is clamped or otherwise fixed in place to the base. In this fashion, the moment (M) exerted by the tray about the pivot point with the second end of the arm, together with the weight of any input device, provides sufficient tension on the cable such that it creates sufficient friction with the outer wall of the drum to prevent pivotal movement of the arm about the base. The brake created by the cable may be released by rotating the forward portion of the tray about the pivot point with the second end of the arm allowing the user to move the arm to the desired orientation. With respect to changing the angular orientation of the tray with respect to the worksurface, movement of lever 444 to a point substantially perpendicular to pin 434 releases pin 434 and allows the user to select the desired angular orientation of the tray. The spring 442 maintains tension on cable 332 to keep the brake engaged and the arm at the selected position.

Figure 18:
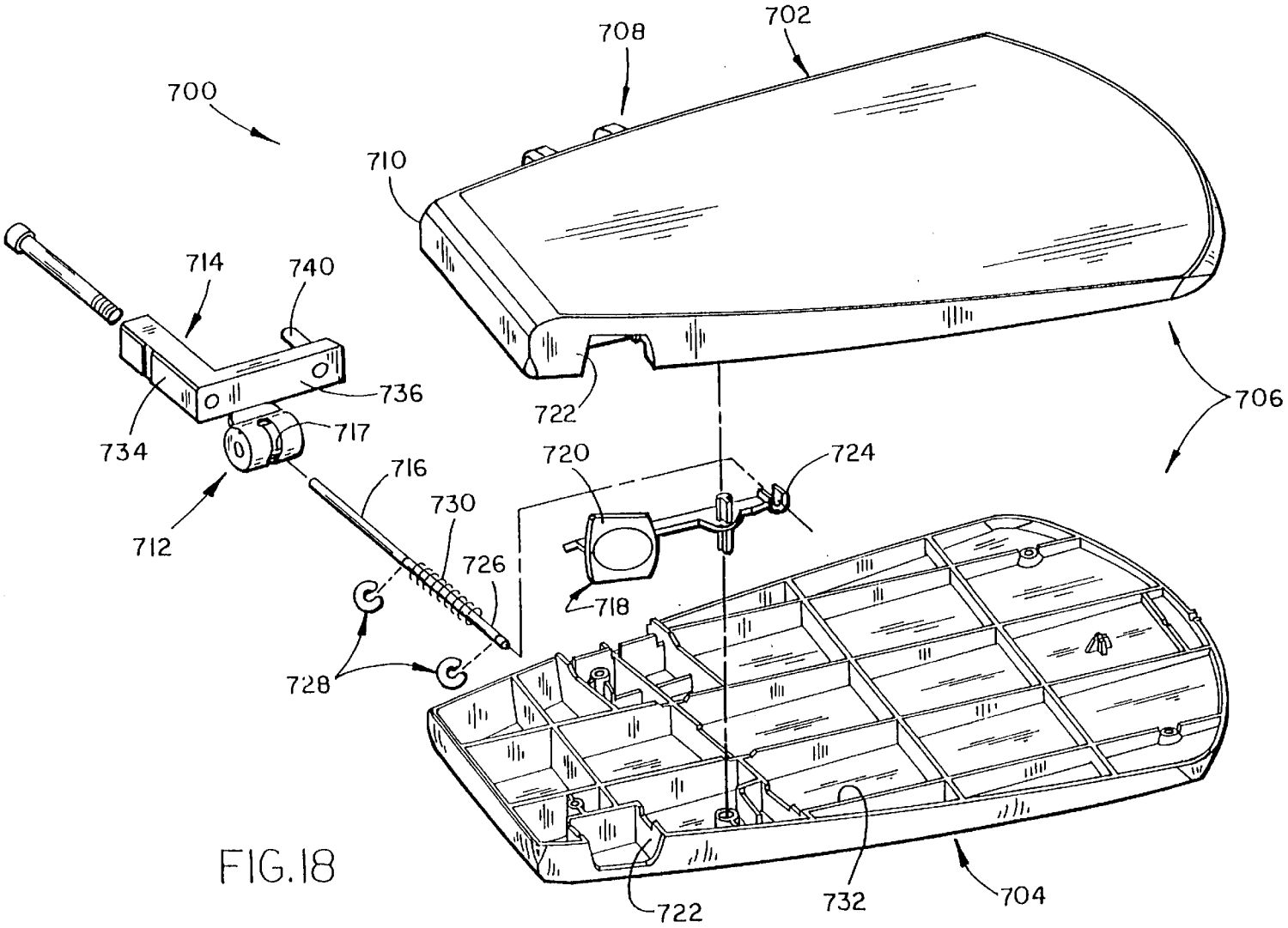
FIG. 18 is an exploded view of one embodiment of the auxiliary support surface to be used with the invention.

Referring to FIGS. 8 and 18, another embodiment 700 of an auxiliary support surface is shown intended for use with a mouse, joystick, rollerball, or other input device (not shown). Auxiliary support 700 is intended to be connected to either end of the tray or platform of the adjustable support mechanism described above. In this particular instance, and in variations thereof, auxiliary support 700 includes body and cover portions 702, 704, respectively, defining a housing 706 having substantially any one of a number of geometric configurations. Housing body 702 and cover 704 may be made using a number of techniques, although injection molding using a high-impact polymeric material is preferred. Extending from a peripheral edge 710 of body 702 is a hinge 708. Hinge 708 is configured to mate with a knuckle 712 to form a hinge joint. Knuckle 712 is, in turn, connected to one end of an anchor member 714 adapted to be received by and fixed in a hole defined in the ends of the trays or platforms.

Auxiliary support 700 is intended to swing about the horizontal axis of the hinge joint formed by knuckle 712 and hinge 708 such that support 700 may be stowed when not in use. To retain support 700 in the horizontal use position, it is contemplated that a releasable locking mechanism be used. For example, a locking pin 716 may be biased within housing 706 and adapted to move back and forth along its axis such that in the extended position, pin 716 engages a recess or socket 717 defined in knuckle 712 and locking it in a fixed orientation. Support 700 can be released by retracting pin 716 to disengage knuckle 712 and pivot freely downwardly about the hinge joint. Pin 716 may be biased such that the pin automatically engages the knuckle when rotated into position. A release button, such as 718, pivotally coupled between housing halves 702, 704 may be provided to withdraw pin 716 from knuckle 712. One end 720 of button 718 is configured to be received in a recess 722 defined by the two halves. The opposite end 724 of button 718 is attached to one end 726 of the pin. C-clips 728 or other structures may be located along the length of pin 718, one adapted to engage one end of a compression spring 730. The opposite end of the spring is configured to butt against one of the ribs 732 in the interior of housing 706. In this configuration, spring 730 biases pin 716 against knuckle 712 such that pin 716 automatically engages a hole in the knuckle when aligned. Depression of end 720 retracts pin 716 and compresses spring 730 which, when released, causes pin 716 to extend out from housing 706.

To provide front-to-back structural stability, anchor member 714 preferably includes a first member 734 received in a hole defined in the end of the tray. Fasteners or other means are provided to retain first member 734 in the hole. First member 734 is pivotally coupled to knuckle 712 by a threaded fastener extending the length of the anchor. Extending generally perpendicular from the end of the anchor adjacent knuckle 712 is a flange 736, the opposite end of which retains a second and smaller member or post 740 oriented in the same direction and parallel to first member 734. Second member 740 is received in a second hole in the end of the tray. Receipt of the two members in the end of the tray provides substantial front-to-back support of auxiliary support 700. Rotational adjustment of the support can be provided about the pivotal coupling of the first member to the knuckle.

Although the embodiments described above contemplate wrapping the brake cable at least partially around a drum at the end of the arm connected to the base, the drum may be located substantially anywhere along the length of the arm including the opposite end. Additionally, the brake cable may be wrapped and attached to the tray such that lifting the rear edge of the tray to pivot about the pivot point with the arm could release the brake as well, provided that the end of the arm is attached to the leading edge of the tray.

According to another form of the invention, although the tray or platform angle with respect to the base or worksurface remains constant with changes in the elevation or height of the platform, some sort of programmed platform angle change can be built in as the platform height is changed. For example, the platform could tilt in a positive direction (front edge down) as the platform is elevated, and tilt in a negative direction as the platform is lowered. This could be accomplished by making the radius of the circular member at the platform end smaller than the drum or circular member at the opposite end. By using a carefully designed cam shape for one of the circular members, nearly any angle versus platform height should be achievable.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

The invention claimed is:

1. An articulated keyboard support assembly, comprising:

a base member adapted for attachment to a support surface;

an arm having a first end pivotally connected to said base member;

a keyboard support platform pivotally connected to a second end of said arm;

a lock interconnecting said keyboard support platform and said base member and shifting between an engaged position wherein said arm is locked relative to said base, and a released position wherein said arm is movable relative to said base, a moment of said keyboard support platform shifting said lock into said engaged position and maintaining a desired angular orientation of said arm with respect to said base member to thereby maintain a desired height of said keyboard support platform; and a tilt adjustment mechanism configured to selectively support said keyboard support platform at a user-selected angle with respect to said base member.

2. The articulated keyboard support assembly as set forth in claim 1, wherein:

said lock includes a lock element and an elongate brake element extending along said arm and interconnecting said platform to said base member, said brake element frictionally engaging said lock element and releasably locking said platform at a desired elevation.

3. The articulated keyboard support assembly as set forth in claim 2, wherein:

said tilt adjustment mechanism includes a tilt rod slidably supported by said platform and connected to said brake element;

said tilt adjustment mechanism includes a lever pivotally connected to said platform, said lever having a hole therethrough defining an inner edge; wherein said tilt rod is disposed within said hole, said lever being pivotable between a released position wherein said tilt rod shifts upon tilting of said platform, and a locked position wherein said inner edge engages said tilt rod to lock said tilt rod and prevent tilting of said platform.

4. The articulated keyboard support assembly as set forth in claim 3, including:

a drum fixed to said arm at said first end; wherein:

said brake element is flexible and tenses in response to said moment of said platform, and slackens upon upward tilting of said platform about said second end of said arm;

said flexible brake element is wrapped around said drum and frictionally engages the same to prevent rotation of said arm about said first end when said cable is tensed.

5. The articulated keyboard support assembly as set forth in claim 2, further including a counterbalance interconnecting said base member and said arm for partially supporting the weight of said arm, said platform, and any device disposed thereon.

6. The articulated keyboard support assembly as set forth in claim 5, wherein said counterbalance includes at least one tensional spring interconnecting said arm to said mounting bracket.

7. An articulated keyboard support assembly as set forth in claim 6, wherein:

said platform has a forwarded portion, and wherein:

said tilt adjustment mechanism includes a slidable wedge; and said lock includes an elongated brake element, an end of said brake element resting upon said wedge in sliding engagement, whereby translation of said wedge in a first direction moves said forward portion of said platform in a first direction, and translation in a second direction moves said forward portion of said platform in a second direction.

8. The articulated keyboard support assembly as set forth in claim 7, wherein translation of said wedge changes the angular orientation of said platform with respect to said base member.

9. The articulated keyboard support assembly as set forth in claim 8, wherein said wedge translates in a direction generally perpendicular to an axis of said elongated brake element.

10. The articulated keyboard support assembly as set forth in claim 1, wherein said platform defines an end and includes an auxiliary support surface detachably connected to said end of said platform and extendable therefrom for supporting another device thereon.

11. The articulated keyboard support assembly as set forth in claim 10, wherein said auxiliary support surface includes:

a housing;

an anchor member received in at least one end of said platform;

a hinge pivotally interconnecting said housing to said anchor member; and a locking member biased within said housing for detachably engaging a recess defined in said hinge for releasably locking said housing in said generally horizontal position.

12. The articulated keyboard support assembly as set forth in claim 11, wherein said hinge is pivotally connected to said anchor member such that said housing may be rotated about an axis concentric with said anchor member.

13. The articulated keyboard support assembly as set forth in claim 1, wherein:

said platform defines a leading edge; and including:

an adjustable palm rest assembly connected to said leading edge of said platform.

14. An articulated keyboard support assembly, comprising:

a base member shaped for connection to a worksurface;

a keyboard support platform movably connected to said base for vertical movement relative to said base, said platform being movable to a position below the worksurface; and a lock interconnecting said platform and said base member, said platform movable to a released position wherein said platform releases said lock to permit height adjustment of said platform; and said platform movable to a locked position wherein said platform engages said lock, such that said lock frictionally retains said platform at a user-selected height at a selected one of a plurality of infinitesimally small increments.

15. The articulated keyboard support assembly as set forth in claim 14, wherein:

said lock is biased into said locked position.

16. The articulated keyboard support assembly as set forth in claim 15, wherein:

said lock is released upon tilting of said platform.

17. The articulated keyboard support assembly as set forth in claim 15, including:

an arm having one end pivotally connected to said base, and an opposite end pivotally connected to said platform.

18. The articulated keyboard support assembly as set forth in claim 17, wherein:

the weight of said platform biases said lock into said locked position.

19. An articulated keyboard support assembly, comprising:

a base member shaped for connection to a worksurface;

a keyboard support platform movably connected to said base for vertical movement relative to said base, said platform including a clamp for securely retaining a keyboard in position on said platform; and a lock interconnecting said platform and said base member, said platform movable to a released position wherein said platform releases said lock to permit height adjustment of said platform; and said platform movable to a locked position wherein said platform engages said lock, such that said lock retains said platform at a user-selected height at a selected one of a plurality of infinitesimally small increments.

20. The articulated keyboard support assembly as set forth in claim 19, wherein:

said lock is biased into said locked position.

21. The articulated keyboard support assembly as set forth in claim 20, wherein:

said lock is released upon tilting of said platform.

22. The articulated keyboard support assembly as set forth in claim 21, including:

an arm having one end pivotally connected to said base, and an opposite end pivotally connected to said platform.

23. The articulated keyboard support assembly as set forth in claim 22, wherein:

the weight of said platform biases said lock into said locked position.

* * * * *

UNITED STATES PATENT AND TRADEMARK OFFICE

CERTIFICATE OF CORRECTION

PATENT NO. : 5,975,474
DATED : November 2, 1999
INVENTOR(S) : Jonathan Ira Kaplan et al.

It is certified that error appears in the above-identified patent and that said Letters Patent is hereby corrected as shown below:

Column 15, claim 7, line 44;
"claim 6" should be --claim 1--.

Signed and Sealed this

Thirtieth Day of May, 2000

*Attest:*

Q. TODD DICKINSON

*Attesting Officer*

*Director of Patents and Trademarks*